US006848288B1

(12) United States Patent
Derman

(10) Patent No.: US 6,848,288 B1
(45) Date of Patent: Feb. 1, 2005

(54) QUICK-RELEASE VALET KEY-RING AND CURRENCY HOLDER

(76) Inventor: Jay S. Derman, P.O. Box 3823, Palos Verdes, CA (US) 90274-9533

( * ) Notice: Subject to any disclaimer, the term of this patent is extended or adjusted under 35 U.S.C. 154(b) by 0 days.

(21) Appl. No.: 10/797,540

(22) Filed: Mar. 11, 2004

(51) Int. Cl.[7] ..... A44B 15/00; A44B 21/00
(52) U.S. Cl. ..... 70/459; 70/756 R; 24/303
(58) Field of Search ..... 70/456 R, 459, 70/456 B, 460; 292/251.5; 63/3.1, 900; 24/303, 3.6

(56) References Cited

U.S. PATENT DOCUMENTS 2,975,497 A * 3/1961 Budreck ..... 70/459
3,108,346 A * 10/1963 Bey ..... 24/303
3,111,736 A * 11/1963 Budreck ..... 24/303
3,127,653 A * 4/1964 Budreck ..... 70/459
3,141,214 A * 7/1964 Bey ..... 24/303
3,186,052 A * 6/1965 Bobrow ..... 24/303
3,192,747 A * 7/1965 Stupell et al. ..... 70/456 R
3,600,917 A * 8/1971 Krock ..... 70/459
4,901,405 A * 2/1990 Grover et al. ..... 24/303
5,209,090 A * 5/1993 Stillwagon ..... 70/456 R
5,226,252 A * 7/1993 Haluska ..... 70/456 R
5,457,976 A * 10/1995 Stillwagon ..... 70/456 R
6,640,398 B2 * 11/2003 Hoffman ..... 24/303

* cited by examiner

*Primary Examiner*—Daniel P. Stodola
*Assistant Examiner*—Christopher Boswell
(74) *Attorney, Agent, or Firm*—Monty Koslover

(57) ABSTRACT

A dual-ended key ring holder device that allows a key ring to be quickly released from one end. Provision is made for display of artwork or advertising and a space inside the holder is provided for storing a currency note. The device employs a strong attractive magnetic force produced by two permanent magnets to ensure that a removable key-ring portion is normally held tightly to the holder. The device is small in size, inexpensive and reliable.

10 Claims, 4 Drawing Sheets

QUICK-RELEASE VALET KEY-RING AND CURRENCY HOLDER

BACKGROUND OF THE INVENTION

1. Field of the Invention

This invention relates to small, easily pocketed devices for holding keys and particularly to key-ring holders that provide for a key-ring to be quickly disengaged from the holder.

2. Background

There exists a number of key-ring holder devices which provide for any given attached key-ring to be quickly disengaged or replaced. This action is required when handing over a car to a valet for parking. However, many of these, devices have key-ring attaching mechanisms that sometimes unintentionally become disengaged, because of wear and a resulting easy disengagement.

While some key-ring holders may provide a surface for company logos, advertising or artwork, none are known to include a secure, hidden storage compartment for a currency note or personal data, and provide a surface for a bar-code.

It is therefore a principal object of the present invention to provide an inexpensive key-ring holder, that will provide for quick manual disengagement and replacement of a key-ring with attached keys, while preventing unintentional or accidental disengagement.

A further object of the present invention is to provide a secure, hidden storage area for a currency note or personal data, and provide a surface for a bar-code.

An even further object is to provide a means for secure display of a photo or artwork.

SUMMARY OF THE INVENTION

The invention is a quick-release valet key-ring holder device which includes provision for display of artwork and a hidden area for storing a currency note. The device housing is generally tubular, including a capped end and a removable nut at its distal open end. It may be cylindrical, in shape or have a number of continuous, longitudinal flat sides. A shaft, to which a key-ring can be attached at one end, is normally disposed axially inside the housing and is held tightly in place by a strong attractive magnetic force. Release of the shaft and its' attached key-ring is effected only by manual application of sharp, axial pull on the exposed key-ring end of the shaft.

Further understanding of the nature and advantages of the invention will be apparent from studying the following portion of the specification, the claims and the attached drawings.

DESCRIPTION OF THE PREFERRED AND ALTERNATE EMBODIMENTS

Figure 1:
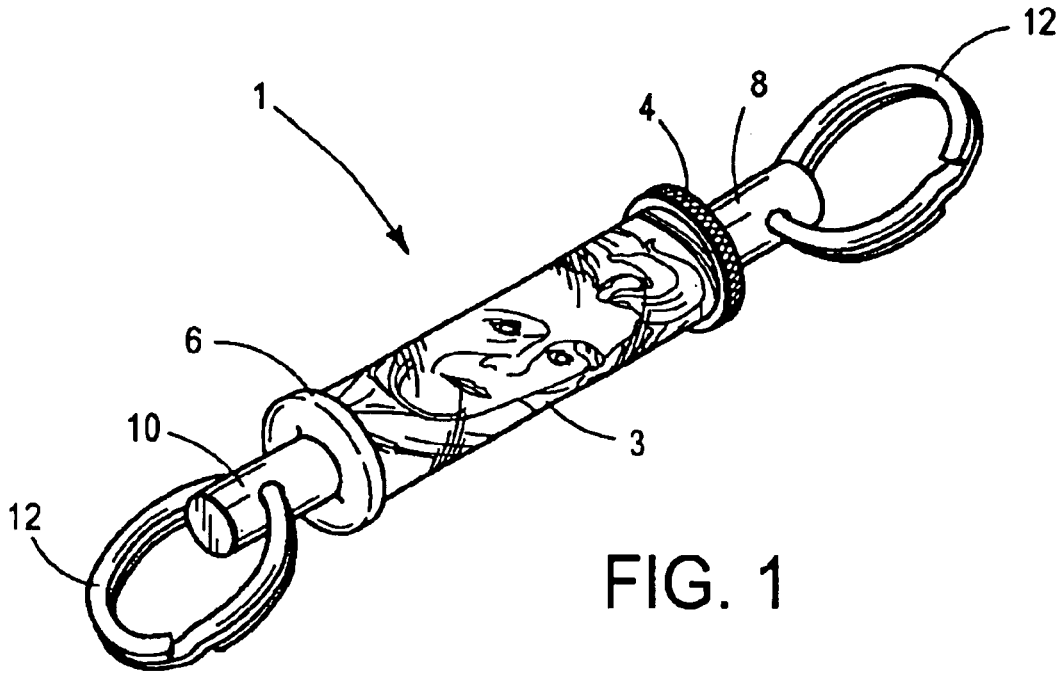
FIG. 1 is a perspective view of a preferred embodiment of a key ring holder device according to the present invention, particularly showing artwork covered by a transparent sleeve placed over the device housing, and with attached key-rings.
Figure 1A:
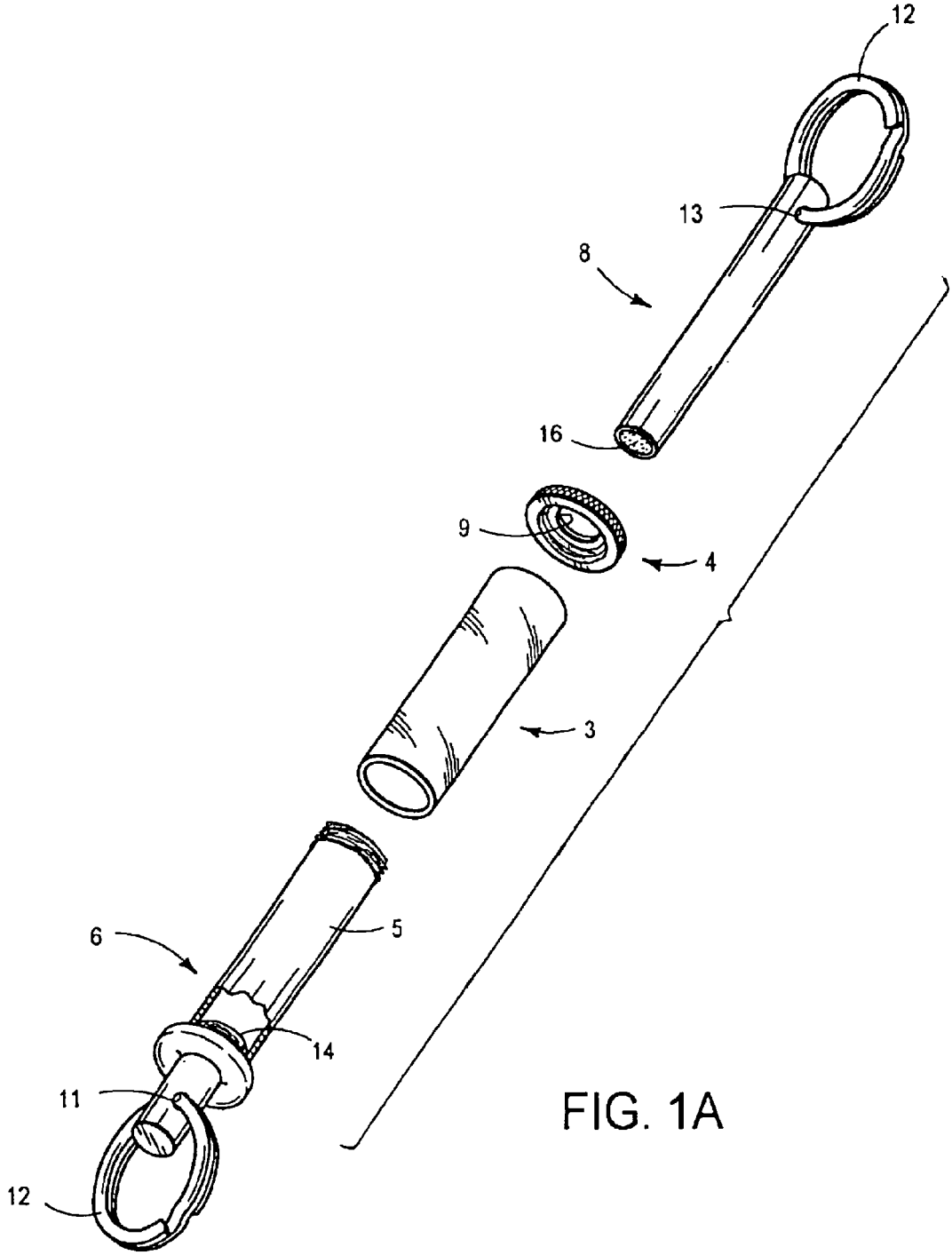
FIG. 1A is an exploded view of the preferred embodiment device, shown with attached key-rings.

Refer now to FIGS. 1 and 1A which show, respectively, a perspective view and an exploded view of the preferred embodiment device plus key-rings. The device comprises a tubular housing 6 which has one end capped and a distal end open; a transparent plastic sleeve 3 which fits around the housing body portion 5; a nut 4 that fastens to the open end of the housing; and a shaft 8. After the sleeve 3 is placed over the housing body portion 5 and the nut 4 is fastened in place, the shaft 8 is inserted through a hole 9 in the nut 4 into the housing cavity where it is immediately attracted by a strong magnetic force toward the capped end of the cavity and held there.

The strong magnetic force is applied by a neodymium (Nd—Fe—B) magnet disc 16 that is embedded in one end of the shaft 8, and by another neodymium magnet disc 14 that is set in the inside surface of the housing cap portion that closes an end of the housing cavity. The coercive force exerted between the two permanent magnets is listed as 9300 Oersteds or higher by the manufacturer. This strong force pulls the magnet disc 16 end of the shaft 8 axially toward the magnet disc 14 and holds it there. However, a sharp pull at the key-ring protruding end of the shaft 8 will release the shaft 8 and allow it to be pulled out when needed.

As illustrated in FIG. 1, a folded note may be stored, wrapped around the device housing body 5 and under a clear plastic sleeve 3. The plastic sleeve 3 may optionally be made opaque if it is desired to hide a note from view. There is also room for another folded note to be stored hidden in a cavity inside the device housing. Both notes are secured from falling out by the fastening nut 4, which impinges on the end edge of the plastic sleeve 3. The circumference edge of the nut 4 is knurled to facilitate manual tightening the nut 4 on the housing.

A photo or advertising logo may similarly be displayed, placed wrapped around the housing and under the sleeve 3. Further, the sleeve 3 may be dispensed with, and a logo or message may be embossed on the device housing, if that is desired by a user. These are options available to a device user in addition to the device basic use of providing a quick release key-ring holder.

Figure 3:
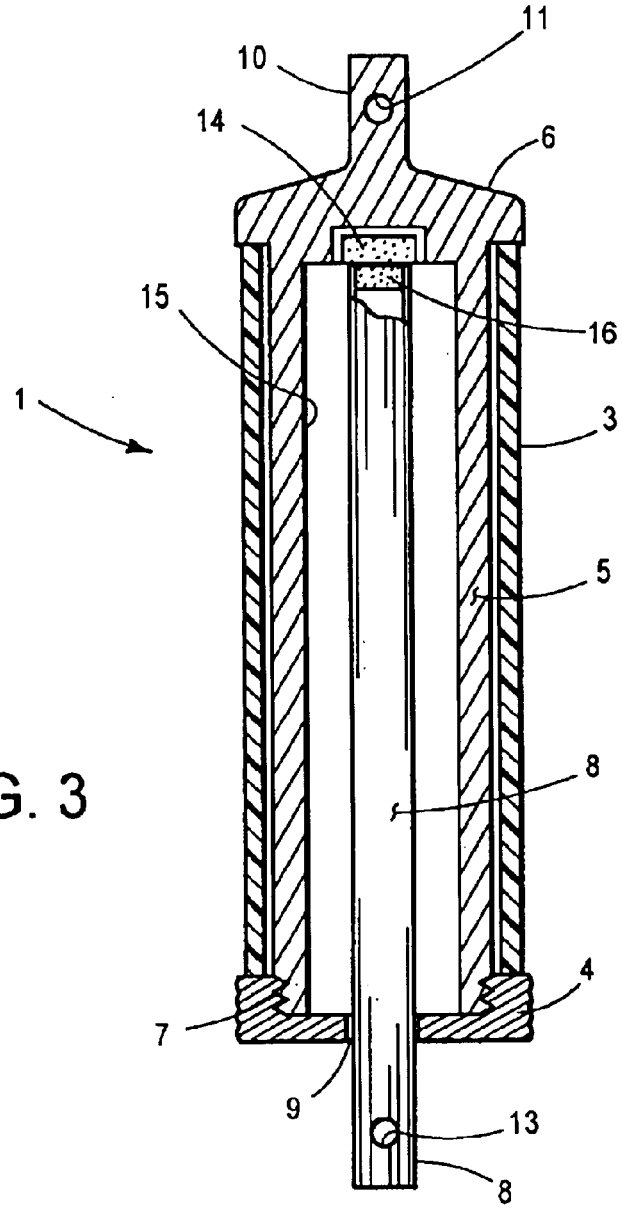
FIG. 3 is a cross-section side elevation view of the preferred embodiment device, particularly showing a permanent magnet disc set in the surface of a closed end of the housing axial cavity, and adhering to another permanent magnet disc that is set in an end of an axially removable shaft.
Figure 4:
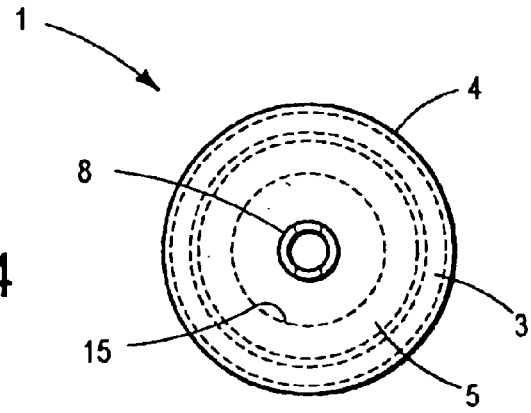
FIG. 4 is an end view of the preferred embodiment device, particularly indicating the circular, lateral shape of all the device component parts.

Refer now to FIGS. 3 and 4 which are respectively, a cross-section, side elevation view and an end view of the preferred embodiment key-ring holder 1 according to the present invention.

An arm member 10 that extends axially above the capped end of the housing 6, includes a hole 11 which is sized for fastening a key-ring thereto.

A shaft 8, with a permanent magnet disc 16 in one end, is shown being held inside the housing axial cavity 15, and up against another permanent magnet disc 14 that is set in the capped end of the cavity, and with a free end extending outside the housing. Both magnet discs are permanent magnets made of neodymium (Nd—Fe—B) material and have a very strong magnetic coercive force.

Since the magnet discs will directly face each other when the shaft 8 is inserted even a small distance into the housing, an inserted shaft experiences a strong attractive force pulling it axially toward the cavity end wall, to which it becomes adhered.

A nut 4 is provided to prevent the sleeve 3 from sliding off the housing body 5 by fastening to the open end of the housing, and to provide passage of the shaft 8. The fastening means, as shown in FIG. 3, consists of internal threads 7 on the nut 4 and external threads on the open end of the housing 5 that are mutually engageable.

The length of the shaft 8 is selected to ensure that an end portion will protrude from the housing when the shaft is held tightly by the magnets. As for the distal end of the device, the exposed shaft end portion includes a hole 13 for fastening a key-ring thereto.

When a key-ring and an attached key are fastened to the exposed end of the shaft 8, an applied sharp, axially directed pull on the key-ring will cause the magnet disc 16 which is embedded in the shaft distal end, to disengage from the magnet disc 14 in the cavity end wall. This allows the shaft 8 plus its' attached key-ring to be completely withdrawn from the housing 6 for handing to a valet. When desired, the shaft 8 can be quickly replaced in the device by insertion through the axial opening 9 in the fastening nut 4. It will then snap immediately into position, held by the magnet's attractive force.

The diameter of the axial cavity 15 in the housing body 5 is made sufficiently large so that a folded currency note or other thin material may be hidden and stored in the cavity without interfering with movement of the shaft B. This attribute could be advantageous to users of the device who would like to have emergency money available, but hidden from view.

There are possible advertising applications for the key-ring holder that involve placing a bar code or a particular company logo on the device housing. These items usually require a reasonably flat surface for proper display, and could be placed on a key-ring holder that is configured with flat longitudinal sides. Such a configuration is shown in perspective in FIG. 2 as an alternate embodiment of the present invention key-ring holder device.

In this alternate embodiment 2, the housing 26 sleeved body has continuous longitudinal flat sides instead of being cylindrical in shape. The cap portion of the housing 26 and the fastening nut 24, are necessarily also flat-edged to match the flat-sided body configuration. The internal parts of the device, which are an elongated shaft 28 and two neodymium (Nd—Fe—B) permanent magnet discs 34, 36, are the same as those described earlier for the preferred embodiment. The magnets are located and act in the same way as described earlier for securing and quick release of the shaft 28 with an attached key-ring 31.

Similarly, a photograph or folded note may be wrapped around the flat sides of the housing body and a clear sleeve 23 placed over the body and secured by the fastening nut 24. Or an advertising message may be placed under the sleeve 23 or embossed directly on the housing body sides. The sleeve 23 may be made opaque to hide the contents if so desired. Also, the fastening nut 24 may be cemented in place to prevent access to the device contents.

Figure 2:
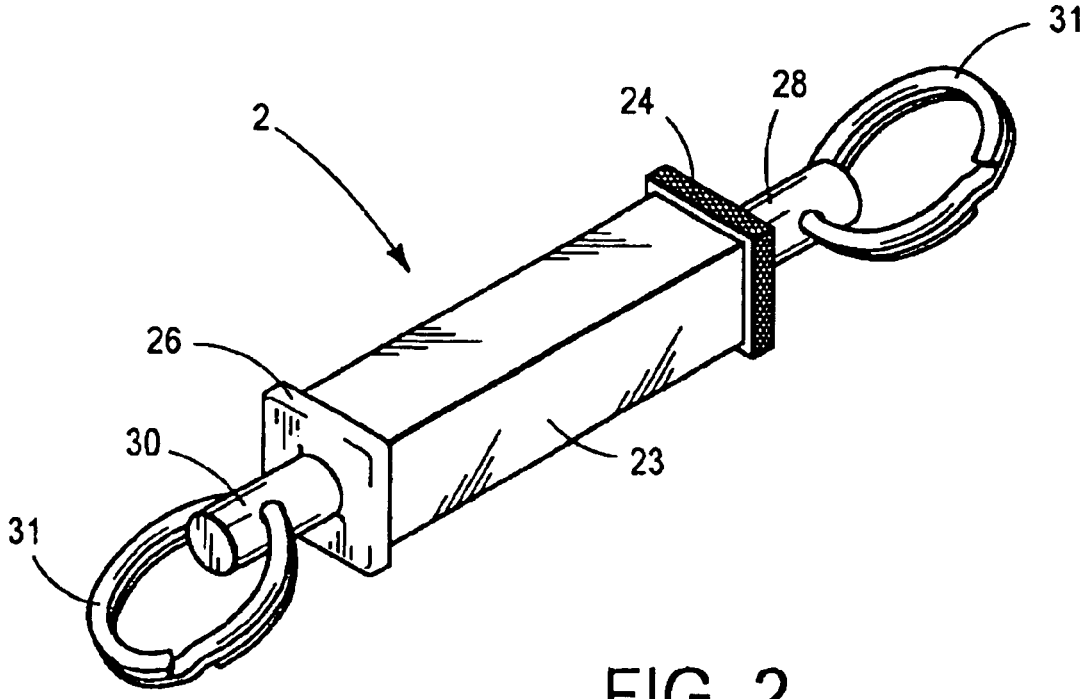
FIG. 2 is a perspective view of an alternate embodiment of a key ring holder device according to the present invention, particularly showing a flat sided shape of the device housing and covering sleeve, and with attached key-rings.

The drawing in FIG. 2, shows the housing body 25 and sleeve 23 as having four longitudinal sides. This is one of several possible configurations. Indeed, the body and sleeve could have a multiple number of longitudinal sides, which may be as few as three, or more than four. Further, the sides need not be made equal in width. These variations depend on the configuration preferences of the device user.

Figure 5:
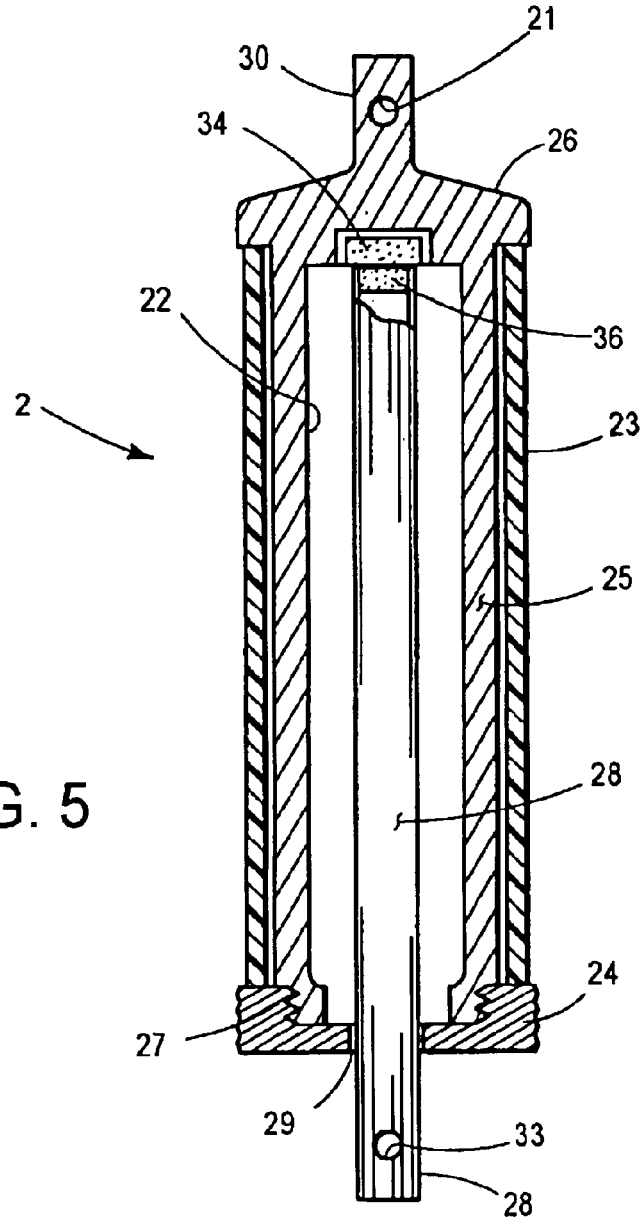
FIG. 5 is a cross-section elevation view of the alternate embodiment device, particularly showing the same internal construction as the preferred embodiment device.
Figure 6:
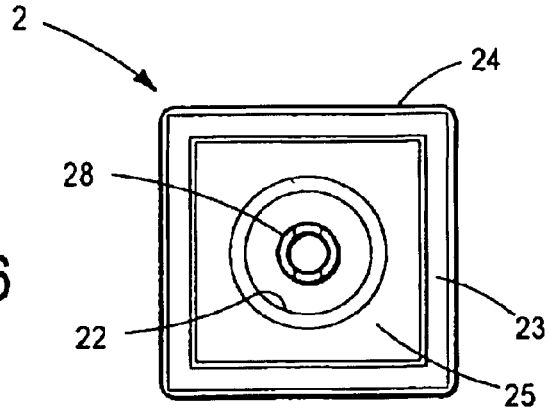
FIG. 6 is an end view of the alternate embodiment device, particularly indicating the generally flat-sided configuration of the device external component parts.

Referring now to FIGS. 5 and 6, there is shown a cross-section side elevation view and an end view of an alternate embodiment 2 of the present invention key-ring holder.

The housing 26 has a body portion 25 that is tubular in shape with multiple, flat sides and an internal, axial longitudinal cavity 22. A cap portion of the housing closes off one end of the axial cavity 22. An arm member 30 extends axially from the capped housing surface and includes a hole 21 for fastening a key-ring thereto.

As in the preferred embodiment, a neodymium (Nd—Fe—B) permanent magnet disc 34 is attached, set in a recess cut in the surface of the cap portion that forms the closed end of the cavity 22. This magnet disc 34 is positioned so that it will directly face another neodymium permanent magnet disc 36 which is embedded in an end of an axially located shaft 28; thus attracting the otherwise free shaft 28 to the closed end of the cavity.

A fastening nut 24 includes an axial opening 29 to allow passage of the shaft 28, and also includes a means for fastening the nut 24 to an open end of the housing 26.

In FIG. 5, mutually engaging threads 27 are cut in the housing end and in the nut to enable fastening the nut to the housing.

A plastic sleeve 23 which has multiple flat sides matching those on the housing 25, is loosely fitted over the housing body 25 and kept in place by the fastening nut 24. The sleeve may be made transparent or opaque.

As for the preferred embodiment, the diameter of the axial cavity 22 in the housing is made sufficiently large so that a folded note or other thin material may be hidden and stored in the cavity, without interfering with movement of the shaft 28.

From the foregoing description and an examination of FIGS. 5 and 6, it is apparent that the alternate embodiment differs from the preferred embodiment only in the external shape of the sleeve, the housing and the fastening nut. Both devices function in exactly the same manner and have the same attributes of quick-release of a key-ring, display of a photo or advertising, and providing a secure, hidden place for storing a currency note.

In both embodiments, all the parts except for the magnets could be fabricated or formed, using rigid plastic materials or metals, such as aluminum.

The invention key-holder device as described herein, has few parts and is simple in construction. It is inexpensive to produce in quantity, and should have a long, useful life.

From the foregoing description, it is believed that the preferred embodiment achieves the objects of the present invention. Various modifications and changes may be made to the invention device described above which are apparent to those skilled in the art. These alternatives and modifications are considered to be within the scope of the appended claims and are embraced thereby.

Having described the invention, what is claimed is:

1. A key ring holder device, which comprises:

a tubular housing, having a cylindrical body portion that includes a coaxial, cylindrical cavity that extends from a top end to a distal end of said body portion, said distal end being open to said cavity and shaped to form an attachment end; and a substantially planar disc-shaped cap portion that closes off said top end of said cavity; said cap portion having an exposed upper surface and a lower face that forms a top end wall of said cavity; and including an arm member which extends axially from said upper surface, said arm member including a first hole that is sized for fastening a key-ring thereto;

a substantially planar disc-shaped nut having a circular, axial opening;

means for removably attaching said nut to said attachment end of said housing;

a sleeve, sized and shaped to slidably fit over said body portion of said housing, with defined space for wrapping a note or photograph around body portion;

a first neodymium (Nd—Fe—B) magnet disc which is attached and set into said lower face of said cap portion in said cavity, concentric with said cavity; and an elongated, rigid shaft that is sized in length to extend substantially beyond said body portion of said housing; said shaft including a second neodymium (Nd—Fe—B) magnet disc that is set in one end of said shaft, and having a second hole bored transversely and located near a distal end, said second hole being sized for fastening a key-ring thereto and defining a key-ring end;

said shaft normally being disposed axially inside said cavity in said housing, and held tightly at one end by an attractive magnetic force to said first neodymium magnet disc that is fixed in said end wall in said cavity; said distal end of said shaft extending through said axial opening in said nut; said shaft enabled for quick release by a manual application of a sharp, axial pull on said key-ring end.

2. The device as defined in claim 1, wherein said cavity in said body portion of said housing is sized to permit storage of a folded note while permitting easy axial movement of said shaft through said cavity.

3. The device as defined in claim 1, wherein said means for removably attaching said nut includes an external threaded portion on said attachment end of said housing and mutually engageable internal threads on said nut.

4. The device as defined in claim 1, wherein said sleeve is made from a transparent plastic material.

5. The device as defined in claim 1, wherein said sleeve is made from an opaque plastic material.

6. A key ring holder device, which comprises:

a tubular housing, comprising a body portion which has a multiplicity of continuous, longitudinal flat surfaces and includes a coaxial, cylindrical cavity that extends from a top end to a distal end of said body portion, said distal end being open to said cavity and shaped externally to form an attachment end; and a substantially planar cap portion having a multiplicity of continuous, circumferential flat edges, that closes off said top end of said cavity; said cap portion having an exposed upper surface and a lower face that forms a top end wall of said cavity; and including an arm member which extends axially from said upper surface, said arm member including a first hole that is sized for fastening a key-ring thereto;

a nut having a multiplicity of continuous, flat sides matching said body portion, and including a circular, axial opening;

means for removably attaching said nut to said attachment end of said housing;

a sleeve, sized and shaped to slidably fit over said body portion of said housing, with defined space for wrapping a note or photograph around body portion;

a first neodymium (Nd—Fe—B) magnet disc which is attached and set into said lower face of said cap portion in said cavity, concentric with said cavity; and an elongated, rigid shaft that is sized in length to extend substantially beyond said body portion of said housing; said shaft including a second neodymium (Nd—Fe—B) magnet disc that is set in one end of said shaft, and having a second hole bored transversely and located near a distal end, said second hole being sized for fastening a key-ring thereto and defining a key-ring end;

said shaft normally being disposed axially inside said cavity in said housing, and held tightly at one end by an attractive magnetic force to said first neodymium magnet disc that is fixed in said end wall in said cavity; said distal end of said shaft extending through said axial opening in said nut; said shaft enabled for quick release by a manual application of a sharp, axial pull on said key-ring end.

7. The device as defined in claim 6, wherein, said cavity in said body portion of said housing is sized to permit storage of a folded note while permitting easy axial movement of said shaft through said cavity.

8. The device as defined in claim 6, wherein, said means for removably attaching said nut includes an external threaded portion on said attachment end of said housing and mutually engageable internal threads on said nut.

9. The device as defined in claim 6, wherein said sleeve is made from a transparent plastic material.

10. The device as defined in claim 6, wherein said sleeve is made from an opaque plastic material.

* * * * *